United States Patent [19]

Doerfler

[11] 4,445,629

[45] May 1, 1984

[54] CONTAINER FILLING MACHINE PRODUCT DISPENSING CYLINDER

[75] Inventor: Frederick B. Doerfler, Pittsburgh, Pa.

[73] Assignee: Horix Manufacturing Company, Pa.

[21] Appl. No.: 210,832

[22] Filed: Nov. 26, 1980

[51] Int. Cl.[3] ..... B67D 5/58

[52] U.S. Cl. ..... 222/148; 222/318; 222/376; 222/386.5; 222/389; 138/30; 138/31

[58] Field of Search ..... 222/148, 309, 318, 332, 222/375, 376, 386.5, 387–389; 92/79; 91/25; 138/30–31

[56] References Cited

U.S. PATENT DOCUMENTS 4,091,969 5/1978 Easter et al. ..... 222/309

FOREIGN PATENT DOCUMENTS 691105 7/1964 Canada ..... 91/25

1625994 10/1970 Fed. Rep. of Germany ..... 138/30

*Primary Examiner*—Charles A. Marmor

*Attorney, Agent, or Firm*—Carothers & Carothers

[57] ABSTRACT

In a pressure-fill container filling machine a vertical dispensing cylinder contains a piston that is forced upwardly by liquid product entering an inlet-outlet port in the bottom of the cylinder, the piston being forced downwardly by air pressure to expel the product from the volume chamber beneath the piston. The side of the cylinder at the upper end of the volume chamber is provided with a normally closed bleed passage for air. A tubular member extending downwardly from the inlet-outlet port has a lateral outlet opening connected by a by-pass passage with an inlet to the volume chamber spaced laterally from the inlet-outlet port. A check valve in the by-pass passage permits flow of liquid product therethrough under pressure from the tubular member only toward the volume chamber for flushing air out through the bleed passage while the piston is held in its lowest position.

2 Claims, 1 Drawing Figure

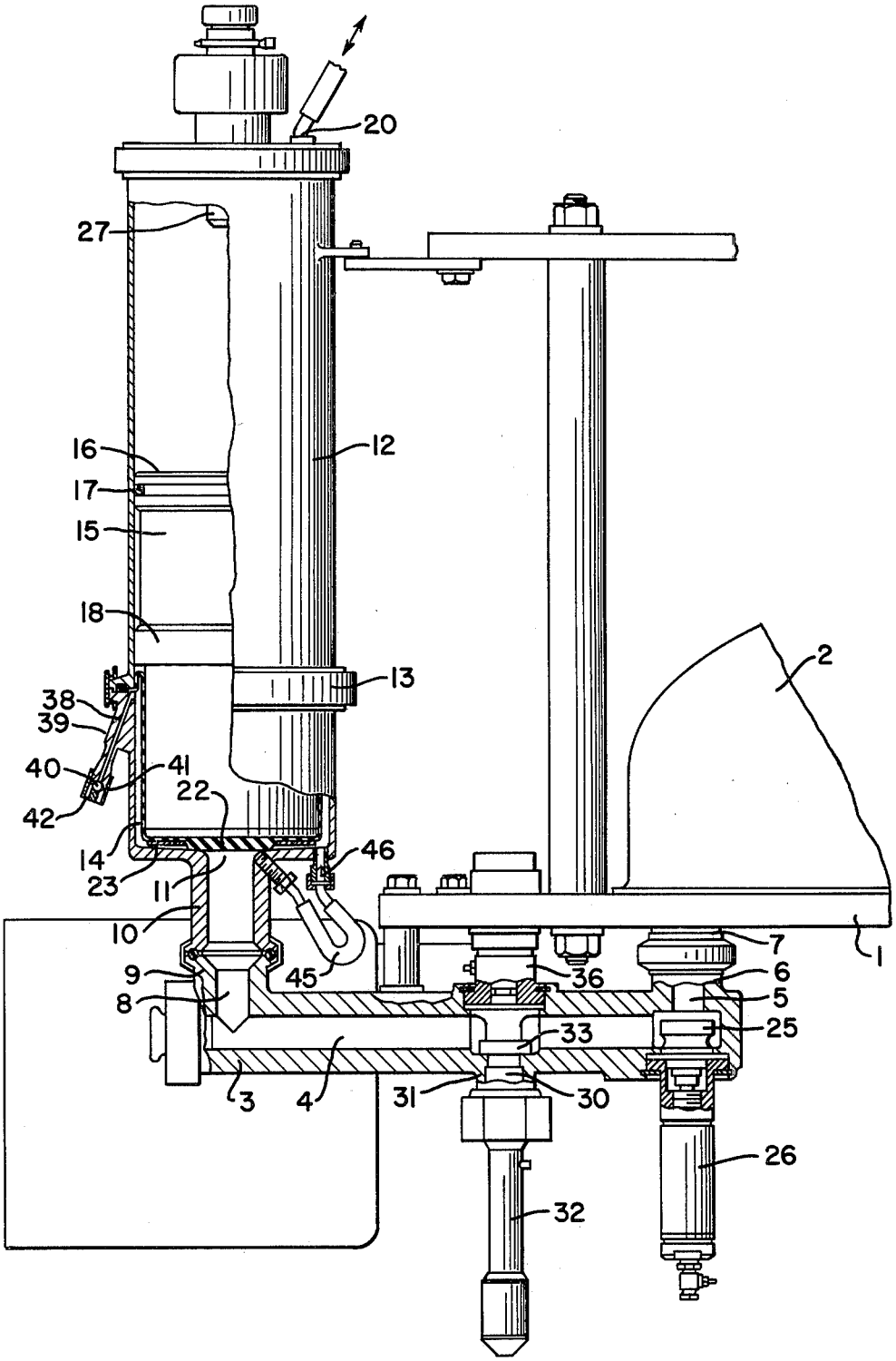
20
27
16
17
15
18
12
13
38
39
40
41
42
22
14
23
11
46
10
9
8
45
36
7
6
5
25
33
3
4
31
30
26
32
2
1

CONTAINER FILLING MACHINE PRODUCT DISPENSING CYLINDER

U.S. Pat. No. 4,091,969 shows a container filling machine with an adjustable-volume dispensing cylinder. The cylinder is provided in its lower portion with a cup-shape flexible diaphragm secured to a piston extending up into the cylinder. When the piston is in its lower position, in which the diaphragm closes a port in the bottom of the dispensing cylinder, liquid product is forced out of the machine's supply tank and up through the port into the lower part of the cylinder or volume chamber. This forces the diaphragm and piston upwardly until the latter can move no farther. Then the tank valve is closed and a valve to the container-filling nozzle is opened and the piston is moved downwardly by air pressure to cause the diaphragm to force the liquid product out of the volume chamber and into a container.

During repeated filling of the volume chamber with liquid product, air can accumulate in the chamber. Excessive air accumulation will cause the volume of the product in the chamber to vary, thus affecting filling accuracies. Sources of air may be air actually in the product or air rising up from the container filling tube. The normal method for removing this air from the volume chamber is by bleeding it off, in which the volume chamber first is filled with liquid product and then the machine's "fill" switch is actuated and simultaneously the bleed valve is opened. The piston is driven downwardly by air pressure and some of the liquid product with entrained air is forced out through the bleed valve. When this flow starts to slow down but before it stops flowing completely, the bleed valve is closed. The above steps are repeated until the product flowing from the bleed valve appears to be free of air. This will usually require from three to five cycles. At the conclusion of the bleeding operation the bleed valve is closed with the piston in its upper position so that the volume chamber is full of liquid product.

It has been found that the bleeding just described removes large air bubbles clinging to the surface of the diaphragm, but the bleeding sequence becomes a tedious operation if it must be done more than once a day. Furthermore, tests have shown that this bleeding method does not flush out small air bubbles, which remain entrapped and adhere to the surface of the diaphragm.

Another objection is that if the piston remains in its down position for a period of time, in which the inlet-outlet port is closed by the diaphragm, the original pressure in the volume chamber may decay, with the result that the diaphragm near its reverse bend at its upper end is no longer snug against the wall of the piston or the chamber. Then, later cycling of the piston may cause the diaphragm to pinch and be deformed, resulting in premature diaphragm failure. Also, the decaying pressure effect increases the force required to raise the piston away from its port closing position and in some cases prevents the piston from rising. Moreover, considerable force may be required to start the piston moving upwardly because the full area of the piston is not under pressure from the liquid product, due to the effective pressure area of the piston being reduced to the area of the inlet-outlet port.

It is among the objects of this invention to provide a container filling machine similar to the one in the above-mentioned patent, from which substantially all of the air in the volume chambers can be flushed, in which the volume chamber remains pressurized, and in which a greater upward force is available for initially moving the piston up away from the inlet-outlet port.

The preferred embodiment of the invention is illustrated in the accompany drawing, in which the single FIGURE is a vertical section through one of the product dispensing cylinders.

Referring to the drawing, a circular table 1 of a container-filling machine is rotatably mounted on a vertical axis and is driven continuously by conventional means not shown. Mounted on the table is a supply tank 2 for the liquid product with which containers are to be filled. The top of the tank is sealed, except for an opening that is connected by a hose (not shown) to suitable apparatus for maintaining pressure on the liquid product in the tank. The rotating table supports a plurality of horizontal conduit arms 3, only one of which is shown, extending radially away from the tank at circumferentially spaced intervals. Each rigid arm is provided with a longitudinal passage 4, the inner end of which opens into the lower end of a vertical passage 5 extending up through a boss 6 on the inner end of the arm. The boss is connected to a neck 7 extending down from an outlet in the bottom of the tank. The outer end of arm passage 4 opens into the lower end of a vertical passage 8 extending up through a boss 9 on the outer end of the arm. Rigidly mounted on this boss is the lower end of a tubular member or a neck 10 extending downwardly from around an inlet-outlet port 11 in the lower end of a vertical dispensing cylinder 12, which is a volumetric measuring device for the liquid product.

This cylinder has upper and lower sections clamped together by an encircling band 13, with the edge of a flexible diaphragm 14 clamped between the two sections. The diaphragm is cup-shape when in its normal shape and divides the cylinder into upper and lower chambers, the lower chamber being a volume chamber for a liquid product. For economy of manufacture, the inner diameter of the cylinder preferably is uniform substantially from end to end. In the chamber above the diaphragm there is a long piston 15 that slides against the wall of the chamber. For best results, most of the piston is spaced slightly from the cylinder wall, but its upper end is enlarged to form an integral collar 16 that engages that wall and is provided with a circumferential groove in which a sealing ring 17 is mounted. To maintain the lower end of the piston concentric with the cylinder, the piston is provided some distance below its upper end with an encircling collar 18 that slides against the cylinder wall. Below this collar the piston is spaced from the side wall of the encircling cylinder and extends down into the cup-shape diaphragm. The piston fits in the diaphragm snugly and the lower end of the piston engages flat against the bottom wall of the diaphragm.

With the piston and diaphragm in their lower position, the diaphragm engages the bottom of the cylinder and closes the port beneath it. The upper part of the diaphragm extends a short distance above the joint between the two sections of the cylinder and is doubled back upon itself. The rest of the side wall of the diaphragm is spaced a short distance from the cylinder wall to provide an annular space between them, in which the side wall of the diaphragm can roll as the diaphragm is moved upwardly from its lowest position. Near the top of the cylinder there is an inlet 20 for air under pressure to drive the piston down.

To provide a good seal for the inlet-outlet port 11 in the bottom of the dispensing cylinder, it is preferred that the central portion of the bottom wall of the diaphragm be thickened to form a circular pad 22 that will engage a narrow area of the bottom of the cylinder around the inlet-outlet port. In any event, the rest of the bottom of the diaphragm should be spaced from the bottom of the cylinder, so that the pressure of the diaphragm against the cylinder bottom will be concentrated in a small area and liquid product can be accommodated between the bottom of the diaphragm and the bottom of the cylinder. The bottom wall of the diaphragm may be bonded to the bottom of the disc by a suitable adhesive, or it can be held tightly against the piston by an annular plate 23 encircling pad 22 and bolted to the piston.

The outlet from the supply tank is controlled by a valve 25 at the lower end of passage 5. This valve can be raised and lowered in any suitable manner, such as by a plunger in a fluid pressure cylinder 26. The valve normally is held closed by air pressure delivered to the lower end of this cylinder, but when this pressure is reduced sufficiently and the upper end of the dispensing cylinder has been connected with the atmosphere through inlet 20, the air pressure above the liquid in the tank will force the liquid down through passage 5 and past the valve and out through arm 3 and up into the lower end of the dispensing cylinder, where the liquid will push the diaphragm upwardly until the top of the piston engages a vertically adjustable stop 27. In this way the dispensing or volume chamber below the diaphragm is filled with the desired quantity of liquid product, the quantity depending upon how far the diaphragm can move upwardly.

In order to fill a container from the dispensing cylinder, the conduit arm 4 has an outlet opening 30 in its bottom between the tank valve and the dispensing cylinder. Extending downwardly from this opening is a neck 31, to the lower end of which a container filling tube 32 is attached for insertion in a container in the usual manner. While the dispensing chamber is being filled from the tank, outlet 30 is closed by a spring-pressed valve 33. This valve is of such shape that is does not block the passage through the arm while the dispensing chamber is being filled.

After the dispensing chamber has been filled as previously described, the tank valve 25 is closed and the product valve 33 is opened by air pressure beneath a piston attached to it and movable upwardly in a cylinder 36. Then air pressure is supplied to the upper end of the dispensing cylinder to force its piston 15 and the diaphragm 14 down in order to discharge liquid from the dispensing chamber down through the filling tube 32 and into a container in which the tube is inserted. If all of the dispensing cylinders of the machine have been adjusted properly, all of them will deliver exactly the same amount of product to the containers. It will be understood that as the table 1 and arms 3 revolve, the dispensing chambers are filled and emptied in succession.

The side of the lower section of the dispensing cylinder is provided with a passage 38 in a tubular projection 39 having at its outer end a conical recess containing a ball valve 40 that is held in place by a cap 41 screwed onto the outer end of the projection. This valve normally is closed. The cap is provided with a passage 42 extending inwardly to the ball.

It is a feature of this invention that a by-pass is provided so that even when port 11 is closed by the diaphragm, liquid product from tank 2 can flow into the restricted space between the diaphragm and the dispensing cylinder. Accordingly, a passage, preferably in the form of a tube 45 of relatively small cross section, extends from an outlet most suitably located in the side of neck 10 to an inlet in the volume chamber, preferably in its bottom. Disposed in this tube is a check valve 46 that opens only toward the volume chamber. The check valve may take various conventional forms, the one shown being the duckbill type.

After initially purging air from the volume chamber in the normal manner described near the beginning of this specification, the filling machine is switched to "cycle override", in which piston 15 is held in its lowest position by air pressure above it. The bleed valve at the lower end of bleed passage 38 is opened and pressure on the liquid product in the tank forces product through the by-pass passage into the volume chamber below and around the diaphragm. High velocity of the product flowing through the reduced area of the volume chamber and the bleed passage will sweep out most, if not all, of any remaining air bubbles clinging to the diaphragm. The bleed valve is then closed and the machine then can be operated in the normal manner.

With the piston held down during cycle override as just described, and with pressure in the tank and passage 4, the volume chamber will remain pressurized through the by-pass passage 45. Consequently, the diaphragm and the reverse bend at its upper end will remain firmly in position, which prevents pinching and premature failure during subsequent piston cycling. Due to the by-pass, fluid pressure is exerted against the larger area of the diaphragm aroung its port-closing pad 22, thereby producing a larger upward force for initially moving the diaphragm and piston upwardly in the dispensing cylinder when the filling machine starts operating. When the piston is forced down in the cylinder the liquid product in the volume chamber is forced out only through the central port 11. None of the product in the volume chamber can escape through the by-pass because check valve 46 prevents flow in that direction.

This invention also is applicable to a dispensing cylinder in which a diaphragm is not used. In such a case the lower end of the piston directly engages the liquid product in the volume chamber. The advantages described herein, except the one relating to the diaphragm, are still obtained.

According to the provisions of the patent statutes, I have explained the principle of my invention and have illustrated and described what I now consider to represent its best embodiment. However, I desire to have it understood that, within the scope of the appended claims, the invention may be practiced otherwise than as specifically illustrated and described.

I claim:

1. In a pressure-fill container filling machine, a vertical dispensing cylinder having an inlet and outlet port in its lower end for liquid product, a piston in the cylinder, the piston being movable upwardly in the cylinder by liquid product forced up through said port, the space in the cylinder below the raised piston forming a volume chamber, the upper part of the cylinder being provided with an inlet for air under pressure to move the piston downwardly to expel liquid product from said volume chamber through said port, the side of the cylinder at the upper end of the volume chamber being provided with a bleed passage for air, and manually operable means normally closing the bleed passage, the improvement comprising a tubular member extending outwardly from said port, said tubular member being provided with a by-pass outlet opening, said cylinder having an inlet opening spaced from said port, a by-pass passage connecting said by-pass outlet opening with said inlet opening, and a check valve in said by-pass passage permitting flow of liquid product from said tubular member only toward said inlet opening for flushing air out through said bleed passage while the piston is held in its lowest position.

2. In a pressure-fill container filling machine according to claim 1, a cup-shape flexible diaphragm in the lower part of said cylinder, and means sealing the edge of the diaphragm to the side of the cylinder above said bleed passage, said piston being secured to said diaphragm and movable therewith.

* * * * *